US010707007B2

(12) United States Patent
Bachinger

(10) Patent No.: US 10,707,007 B2
(45) Date of Patent: Jul. 7, 2020

(54) TRANSFORMER WITH HEATED RADIATOR MEMBER

(71) Applicant: SIEMENS AKTIENGESELLSCHAFT, Munich (DE)

(72) Inventor: Florian Bachinger, St. Georgen/Gusen (AT)

(73) Assignee: Siemens Aktiengesellschaft, Munich (DE)

( * ) Notice: Subject to any disclaimer, the term of this patent is extended or adjusted under 35 U.S.C. 154(b) by 314 days.

(21) Appl. No.: 15/420,603

(22) Filed: Jan. 31, 2017

(65) Prior Publication Data

US 2018/0114626 A1 Apr. 26, 2018

(30) Foreign Application Priority Data

Oct. 26, 2016 (DE) ..... 10 2016 221 080

(51) Int. Cl.

| | |
|---|---|
| ***H01F 27/10*** | (2006.01) |
| ***H01F 27/12*** | (2006.01) |
| ***H01F 27/02*** | (2006.01) |
| ***H01F 27/16*** | (2006.01) |

(52) U.S. Cl.
CPC ..... *H01F 27/12* (2013.01); *H01F 27/025* (2013.01); *H01F 27/16* (2013.01)

(58) Field of Classification Search
USPC ..... 336/57–60, 90
See application file for complete search history.

(56) References Cited

U.S. PATENT DOCUMENTS

| | | | | |
|---|---|---|---|---|
| 4,195,686 | A * | 4/1980 | Pierce | F28F 13/06 165/122 |
| 4,293,030 | A * | 10/1981 | Rambach | F25B 23/00 165/104.32 |
| 4,321,421 | A * | 3/1982 | Pierce | H01F 27/18 174/11 R |
| 2009/0180514 | A1 * | 7/2009 | Anderson | H01F 27/12 374/54 |

FOREIGN PATENT DOCUMENTS

| | | | |
|---|---|---|---|
| DE | 317410 | C | 12/1919 |
| DE | 549192 | C | 4/1932 |
| DE | 19816650 | A1 | 10/1999 |

* cited by examiner

*Primary Examiner* — Mang Tin Bik Lian
*Assistant Examiner* — Kazi S Hossain
(74) *Attorney, Agent, or Firm* — Laurence Greenberg; Werner Stemer; Ralph Locher

(57) ABSTRACT

An electrical device for connecting to a high-voltage power grid has a boiler, which is filled with an insulating fluid and in which a magnetizable core and at least one winding, which surrounds a section of the core, are arranged, and a cooling system which includes at least one radiator which is arranged outside the boiler and is connected thereto via the radiator in order to circulate the insulating fluid, wherein the radiator has at least two heat exchange elements which are connected in parallel with one another. In order to enable a cold start to be accelerated and to be carried out even at relatively low temperatures only one of the heat exchange elements has a heat-conducting connection, as a heated heat exchange element, to a heat source which generates heat when the operation of the electrical device is started.

7 Claims, 3 Drawing Sheets

TRANSFORMER WITH HEATED RADIATOR MEMBER

BACKGROUND OF THE INVENTION

Field of the Invention

The invention relates to an electrical device for connecting to a high-voltage power grid having a boiler, which is filled with an insulating fluid and in which a magnetizable core and at least one winding, which surrounds a section of the core, are arranged, and a cooling system which comprises at least one radiator which is arranged outside the boiler and is connected thereto via the radiator in order to circulate the insulating fluid, wherein the radiator has at least two heat exchange elements which are connected in parallel with one another.

The invention also relates to a method for cold starting an electrical device.

Such a device and such a method are known to a person skilled in the art from experience. Therefore, for example transformers have a boiler which is filled with insulating fluid and in which a magnetizable core is arranged. The core forms a limb which is arranged concentrically with respect to a low-voltage winding and a high-voltage winding surrounding the latter. The insulating fluid serves to electrically insulate the windings, which are at a high-voltage potential during the operation of the electrical device, with respect to the boiler which is at ground potential. Furthermore, the insulating fluid makes available the necessary cooling of the windings. For this purpose, the insulating fluid which is heated by the windings is circulated via radiators which are attached to the outside of the boiler.

The viscosity of the insulating fluid is temperature-dependent and rises very strongly when the temperatures drop. Owing to the increased viscosity, at low external temperatures, less than −10° C., the circulation of the insulating fluid via the radiator or radiators is adversely effected. This is problematic, in particular after a relatively long stationary state of the electrical device, since the insulating fluid is then completely cooled. The high viscosity has to be taken into account in the case of a cold start of the electrical device with respect to the reduced cooling power of the cooling system, since the windings can otherwise be overheated.

A transformer is therefore started in the open-circuit state or under reduced load, for example. If the electrical device has active cooling, pumps for circulating the insulating fluid via the radiator can be switched on only when the insulating fluid has exceeded a minimum temperature threshold value in the boiler. This temperature threshold value is, however, reached only after several days in many cases.

Furthermore, alternative insulating fluids such as esters and silicone oils are being increasingly used in electrical devices of the type mentioned at the beginning. Although ester oils have improved environmental compatibility as insulating fluids, it is disadvantageous that at temperatures in the region of less than −10° C. they can have such a high viscosity that a cold start of the electrical device has virtually become impossible.

BRIEF SUMMARY OF THE INVENTION

The object of the invention is therefore to make available an electrical device and a method of the type mentioned at the beginning with which a cold start is accelerated cost-effectively and can even be carried out at relatively low temperatures.

The invention achieves this object on the basis of the electrical device mentioned at the beginning in that only one of the heat exchange elements has a heat-conducting connection, as a heated heat exchange element, to a heat source which generates heat when the operation of the electrical device is started.

Taking the method mentioned at the beginning as the starting point, the invention achieves the object in that in an electrical device of the type mentioned at the beginning only one of the heat exchange elements is heated as a heated heat exchange element using a heat source.

According to the invention an electrical device is made available which, in order to facilitate the cold start, uses the heat energy made available by a heat source in order to heat selectively a single heat exchange element of a radiator. This heating causes the heated heat exchange element to heat up, with the result that here the insulating fluid is firstly conducted exclusively via the heated heat exchange element after a short amount of time in the case of a cold start. The circulation of the heated insulating fluid via the heated heat exchange element ensures an additional rise in temperature there. The heat is also transferred gradually from the heat exchange element which is heated in this way to the other heat exchange elements.

Within the scope of the invention, the heating of a single heat exchange element is sufficient to set in train the heating of the electrical device. The additional expenditure during the manufacture of the electrical device or during the execution of the method according to the invention is therefore limited to a minimum. The invention avoids high additional costs. Furthermore, the invention permits the use of alternative insulating fluids in relatively colder climate regions.

The cooling system can basically be embodied in any desired fashion within the scope of the invention. Therefore, the cooling system can be a so-called active cooling system which has pumps for circulating the insulating fluid via the radiator or radiators. In contrast to this, the cooling system can also be a passive cooling system in which the movement of the insulating fluid is brought about exclusively by thermal buoyancy. The insulating fluid which is heated by the winding or windings rises owing to its lower density compared to the heated fluid and is replaced by relatively cold insulating fluid which flows on afterward. The difference in weight between the fluid columns which are heated to different degrees in the winding ducts or in the boiler, on the one hand, and the cooling system, on the other, generates a pressure difference which serves as the driving force of the fluid circuit.

In a passive cooling system based on natural flow of the insulating fluid, the circulation starts in the cooling system as result of the heating of the insulating fluid in the heated heat exchange element, since the resistance in the form of a highly viscous insulating fluid is reduced to such an extent that the driving pressure difference sets the circuit in motion.

In the case of pumped oil flow, the heating brings about more rapidly a temperature level which permits the pumps to be switched on. The flow which is required by the pump in the case of a cold start is reduced.

The term heat exchange element is to be understood within the scope of the invention as being a hollow body through which the insulating fluid is conducted. The heat exchange element is in heat-conducting contact, via its outer side, with the external atmosphere, with the result that the heat of the heated insulating fluid can be output to the external atmosphere via the wall of the heat exchange element. In order to improve the transfer of heat, the heat exchange element is composed of a material with a high thermal conductivity, for example of an expedient metal. The exchange of heat is improved further if the heat exchange element has a large heat exchange surface. The heat exchange element or therefore in other words the radiator element, is thus, for example, configured in the form of a plate and has plates or panels which are arranged parallel with one another. The panels can each bound flow ducts which run in a meandering shape and via which the insulating fluid is conducted.

In contrast to this, each heat exchange element is embodied in the form of a pipe and has one or more pipe-shaped heat exchange elements which are connected in parallel with one another. Pipe-shaped elements also have a large surface area.

The radiators can be equipped within the scope of the invention with fans or ventilators with which the cooling of the insulating fluid can be improved further.

According to one advantageous variant of the invention, the heat source is an electrical heating source. The electrical heating source is connected to a power supply for starting the cooled electrical device, with the result that the heated heat exchange element is warmed up. As already stated, the insulating fluid is then conducted essentially via the heated heat exchange element, as result of which the temperature thereof gradually rises further and in this way radiation of the heat to the other heat exchange element is brought about.

According to an expedient development in this regard, the electrical heating source forms heating wires which bear on the heated heat exchange element. Heating wires are available commercially in a cost-effective form and can easily be placed in contact with the heat exchange element to be heated. This variant is therefore particularly cost-effective. Heating wires can also easily be subsequently attached, even during operation.

In a variant of the invention which differs therefrom, the heat source is the boiler which is filled with insulating fluid, wherein the boiler and/or the insulating fluid are/is connected in a heat-conducting fashion to the heated heat exchange element via at least one heat pipe. According to this variant of the invention, a separate electrical heating source has become superfluous. Instead, the heating of the boiler which occurs when the operation is started under reduced load is utilized in order to reduce the viscosity of the insulating fluid in the heated heat exchange element. The electrical device is therefore started, for example, in the open-circuit state, with essentially heating of the core taking place. The heated winding ensures that the insulating fluid which surrounds it is heated and customary convention for heating the boiler housing takes place. The heat which is present in the boiler or the insulating fluid is transferred to the heated heat exchange element via at least one heat pipe.

Heat pipes essentially have a hermetically encapsulated housing in which a working medium, such as, for example, water, is located in liquid and gaseous phase. For example a capillary structure is also arranged in the heat pipe. If the heat pipe is heated at its heat-receiving end, the liquid present there vaporizes and passes via the gas phase to the relatively cold heat-outputting end. A condensation process takes place here, with heat being released. The condensed liquid working medium is transported back to the heat-receiving end of the heat pipe via the internal capillary structure.

A heat pipe is therefore a heat transfer element with which large heating flows can be transferred when there is a small temperature difference. According to this development, the or each heat pipe is either connected in a heat conducting fashion to the insulating fluid within the boiler or else to the boiler itself. The heat of the insulating fluid or of the boiler ensures that the working medium vaporizes within the heat pipe and that the gaseous working medium is transported to the relatively cold end of the heat pipe, which, owing to the heat-conducting connection, outputs the condensation enthalpy arising during condensation to the heated heat exchange element.

According to one development which is expedient in this regard, each heat pipe is in contact, via its heat-receiving end, with the outer wall of the boiler, wherein the heat-outputting end of the heat pipe is in contact with the heated heat exchange element. In other words, the heat pipe bears directly on the boiler and on the heated heat exchange element. When a heat pipe is arranged on the outside of the boiler, the compatibility of the heat pipe with oil does not have to be tested. Furthermore, any risk to the electrical device owing to damage to the heat pipe is also ruled out.

A plurality of heat pipes are advantageously provided within the scope of this variant. Furthermore, it is possible also to equip completed electrical devices, such as, for example, transformers or throttles which are configured for connection to a high-voltage power grid, subsequently with heat pipes which are attached to the outside of the boiler, in order thereby to improve the cold starting behavior of the respective transformer or of the respective throttle within the scope of the method according to the invention.

Each radiator expediently has an upper inflow line and a lower return flow line which are each connected to the boiler and to one another via the heat exchange elements, wherein the heated heat exchange element is at the shortest distance from the boiler. The heat exchange element at the shortest distance from the boiler is also referred to within the scope of the invention as the innermost heat exchange element. Owing to the short distance, the innermost heat exchange element can be easily and cost-effectively heated.

According to a development which is expedient in this regard, a plurality of heat pipes, that is to say at least two heat pipes, are provided which extend between the heated heat exchange element and the boiler in the region of the upper inflow line and, if appropriate, also in the region of the lower return flow line. For the starting of the electrical device it is advantageous to distribute the supply of heat over the entire heat exchange element. Although a natural flow occurs in the heated heat exchange element in the stationary mode only when the temperature of the insulating fluid in the external radiator is lower than the temperature of the insulating fluid in the boiler, excessive heating of the heated heat exchange element could therefore give rise to a reduced rate of circulation. However, it has been observed that, despite the effective transfer of heat of the heat pipes, during normal operation a sufficient temperature difference occurs between the insulating fluid in the boiler and in the heated heat exchange element.

Within the scope of the invention it is expedient to provide a plurality of heat pipes in the upper region, that is to say in the region of the inflow line of the radiator, since in this region the boiler is at relatively high temperatures.

According to a further refinement of the invention, the heated heat exchange element is surrounded at least in certain sections by a heat-insulating layer. This heat insulation simplifies and accelerates the heating of the insulating fluid in the heated heat exchange element.

The cooling system is expediently a passive cooling system. As already stated, passive cooling systems do not have pumps, radiators, or the like.

However, in contrast to this, the cooling system is an active cooling system, wherein, in particular, radiators or radiator batteries with ventilators or fans are used within the scope of the invention.

The electrical device preferably has, within the scope of the invention, a cooling system which has a plurality of radiators, but only one radiator is equipped with a heated heat exchange element. The heated heat exchange element accelerates the heating of the first radiator. However, the heat radiates from said first radiator to the other radiators of the cooling system.

In one advantageous variant of the method according to the invention, the heated heat exchange element is heated using an electrical heating source. In this context, it is particularly expedient if the electrical heating source forms heating wires.

According to one preferred variant of the method according to the invention, the heated heat exchange element is heated by means of at least one heat pipe by the boiler which heats up in the case of cold starting, wherein each heat pipe is arranged between the boiler and the heated heat exchange element.

Further refinements and advantages of the invention are the subject matter of the following description of exemplary embodiments of the invention with reference to the figures of the drawing, wherein identically acting components are provided with the same reference symbols, and wherein

DESCRIPTION OF THE INVENTION

Figure 1:
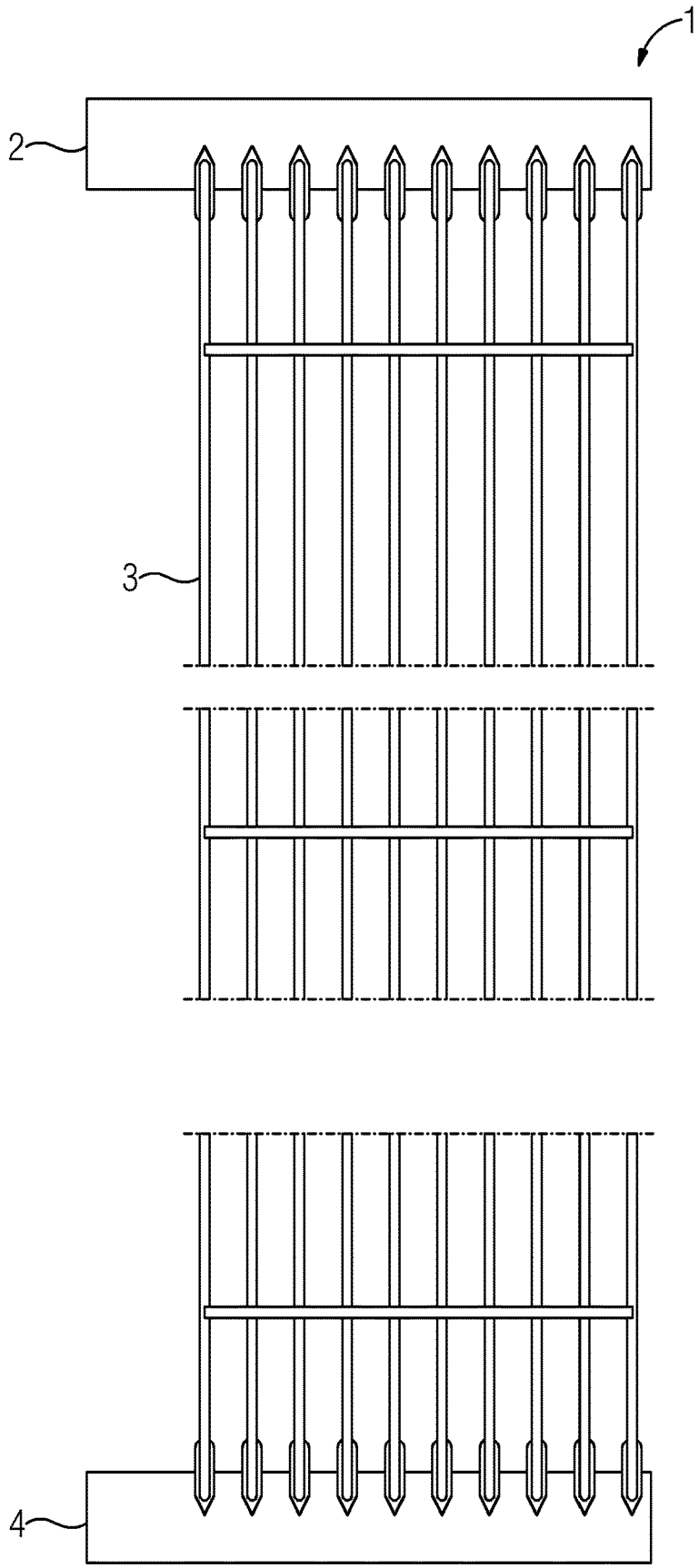
FIG. 1 shows a commercially available radiator in a side view.

FIG. 1 shows an exemplary embodiment of a commercially available radiator 1 in a schematic side view. It is apparent that the radiator 1 has an upper inflow line 2, which is connected hydraulically to a return flow line 4 via heat exchange elements or radiator elements 3. The inflow line 2 and the return flow line 4 each have an input opening or output opening which points to the left and via which the radiator 1 communicates, after being mounted, with the interior of a boiler (not illustrated in FIG. 1). The insulating fluid of said boiler can then be circulated via the inflow line 2, the heat exchange element 3 and the return flow line 4 via the radiator 1 with its heat exchange elements 3. The heat exchange elements 3 are fabricated from a heat-conductive material such as a metal and are in thermal contact with the external atmosphere. If the insulating fluid is conducted via the heat exchange elements, heat is therefore output to the colder external atmosphere by the heated insulating fluid.

Figure 2:
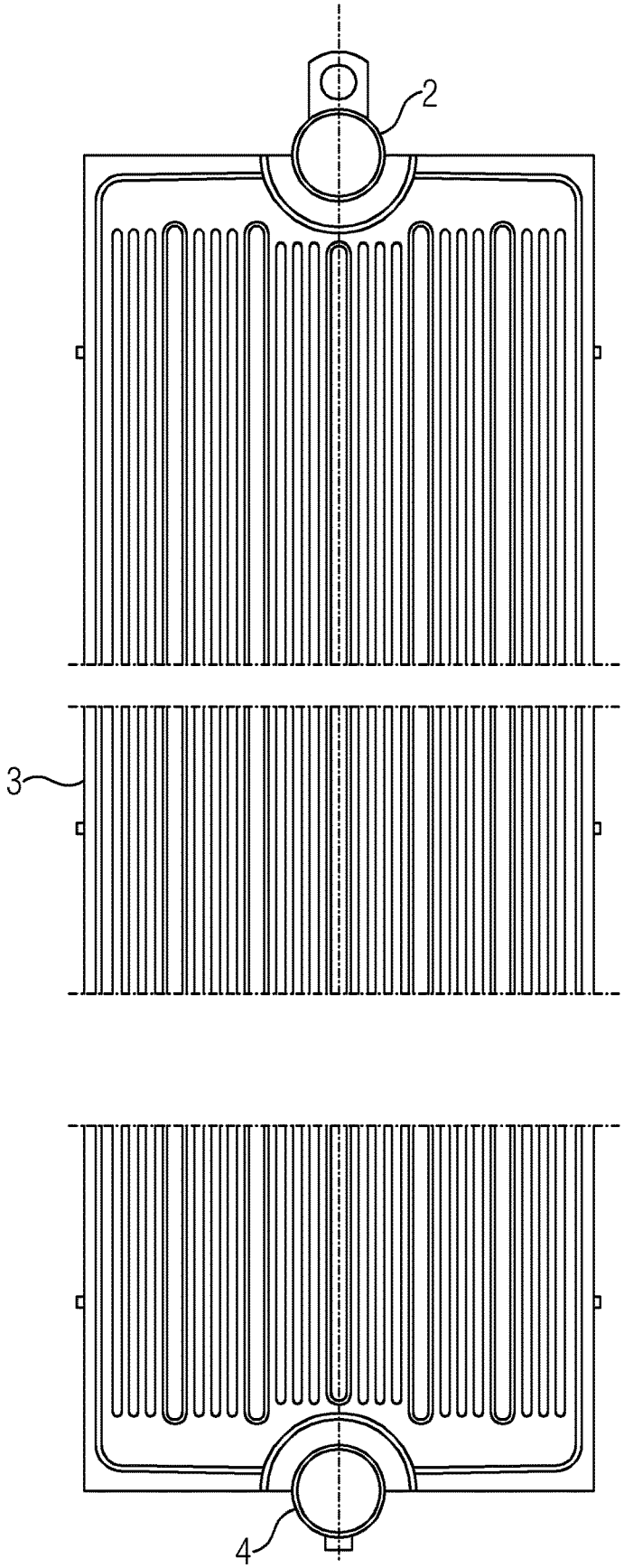
FIG. 2 shows a heat exchange element of the radiator according to FIG. 1 in a plan view.

FIG. 2 shows a heat exchange element 3 in an end view. It is apparent that the heat exchange elements 3 are embodied in a plate shape. In other words, the radiator 1 shown in FIG. 1 is a so-called plate radiator. The plate-shaped heat exchange elements 3 each bound flow ducts through which the insulating fluid circulated via the heat exchange elements 3 is conducted. Finally, the insulating fluid passes into the collecting return line 4 and passes from there as cooled insulating fluid back into the interior of the boiler.

Figure 3:
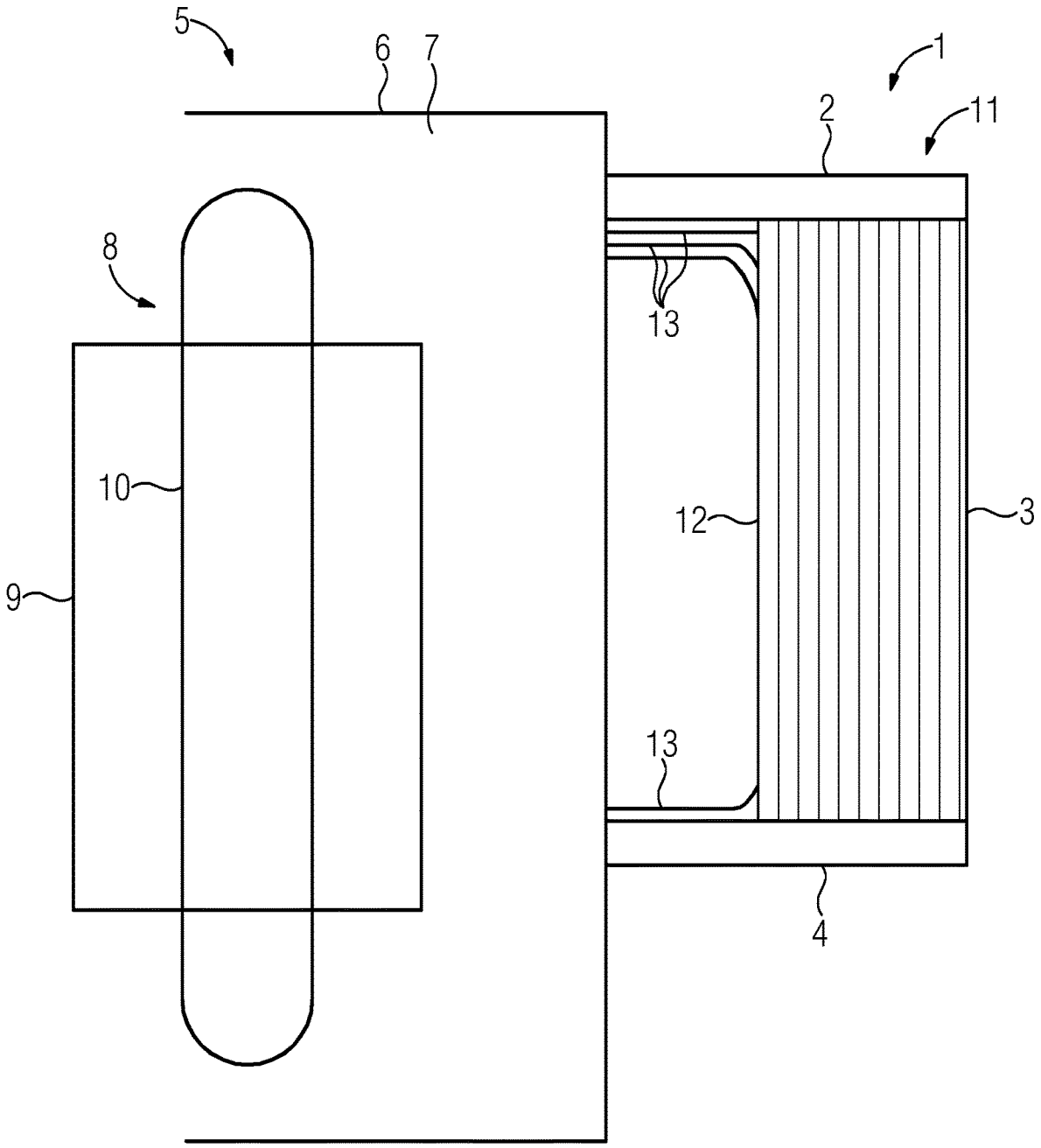
FIG. 3 shows an exemplary embodiment of the electrical device according to the invention in a schematic side view.

FIG. 3 shows an exemplary embodiment of the electrical device 5 according to the invention which is embodied here as a transformer. The transformer 5 has a boiler 6 which is filled with an insulating fluid 7. Furthermore, arranged in the boiler 6 are a magnetizable core 8 and windings 9, of which, however, only one winding is illustrated schematically in FIG. 3. However, the windings 9 comprise here a so-called high-voltage winding and a so-called low-voltage winding which are arranged concentrically to form a limb 10 as a core 8. The method of functioning of such a transformer is, however, known to a person skilled in the art, with the result that at this point more details will not be given on this. The necessary connecting lines for connecting the windings to a high-voltage power grid are likewise not illustrated figuratively for reasons of overview.

The transformer 5 is equipped with a cooling system 11 which is attached to the outside of the boiler 6 and comprises here merely one radiator 1 according to FIG. 1. It is apparent that the inflow line 2 and the return flow line 4 open into the interior of the boiler 6. Since the inflow line 2 and the return flow line 4 are connected to one another via heat exchange elements 3, circulation of the insulating fluid 7 via the radiator is made possible. A heat exchange element 3 which is at the shortest distance from the boiler 6, the so-called innermost radiator element 12, has a heat-conducting connection to the outer wall of the boiler 6 via schematically indicated heat pipes 13.

After a relatively long stationary state of the electrical device 5, the insulating fluid 7 is completely cooled. In particular at low external temperatures, for example in the range of −10 to −50 degrees, the insulating fluid 7 has such a high viscosity, is in other words so viscous, that even after a relatively long starting process it is no longer circulated via the radiator 1. For this reason, the heat pipes 13, with which an improved transfer of heat between the boiler 6 and the innermost heat exchange element 12 is made available, are provided. Therefore, within the scope of the invention the high-voltage winding of the windings 9 can be connected to the high-voltage power grid. The low-voltage winding is, in contrast, applied to a resistor which is expedient for this purpose, with the result that the transformer 5 is not operated under full load. In this context, gradual heating occurs of the insulating fluid 7 and therefore of the outer wall of the boiler 6. Part of the heat which is produced in this context is transferred by means of the heat pipes 13 to the heated heat exchange element 12 which is thus heated, including the insulating fluid 7 arranged therein. The temperature of the heated heat exchange element 12 is therefore higher than that of the heat exchange elements 3 lying further toward the outside. The viscosity of the insulating fluid in the heated heat exchange element therefore decreases. Nevertheless, a difference in temperature occurs between the insulating fluid 7 within the boiler 6 and the insulating fluid within the heated heat exchange element 12, with the result that a pressure difference and therefore circulation of the insulating fluid via the innermost heat exchange element 12 occurs owing to the different densities of the insulating fluid 7. In this context, relatively warm insulating fluid continuously passes via the feed line 2 to the heated heat exchange element 12, wherein gradual heating of the heat exchange elements 3 which lie further toward the outside takes place. Finally, the insulating fluid 7 is also circulated via the heat exchange elements 3 which lie further toward the outside. The transformer can subsequently be operated under full load.

Finally it is to be noted that the load regulation in the case of a cold start can be varied as desired within the scope of the invention. In contrast with the ways of implementing the cold start mentioned above, the electrical device according to the invention can also be started under full load.

The invention claimed is:

1. An electrical device for connecting to a high-voltage power grid, the electrical device comprising:

a boiler filled with an insulating fluid;

a magnetizable core and at least one winding, which surrounds a section of said core, disposed in said boiler;

a cooling system having at least one radiator arranged outside said boiler, said cooling system including an inflow line and a return flow line each connecting said boiler to said radiator in order to circulate the insulating fluid; and at least one heat pipe;

said radiator having at least two heat exchange elements connected in parallel with one another, said at least one heat pipe forming a heat conducting connection between only one of said at least two heat exchange elements and at least one component selected from the group consisting of said boiler and the insulating fluid; and said one of said at least two heat exchange elements being a heated heat exchange element due to heat transferred thereto from said at least one heat pipe.

2. The electrical device according to claim 1, wherein said heat source is an electrical heating source.

3. The electrical device according to claim 1, wherein said at least one heat pipe has a heat-receiving end in contact with an outer wall of said boiler and a heat-outputting end in contact with said heated heat exchange element.

4. The electrical device according to claim 1, wherein said at least one radiator has an upper inflow line and a lower return flow line which are each connected to said boiler and to one another via said heat exchange elements, wherein said heated heat exchange element is at a shortest distance from said boiler.

5. The electrical device according to claim 4, which comprises heat pipes extending both in a region of said upper feed line and in a region of said lower return line between said heated heat exchange element and said boiler.

6. The electrical device according to claim 1, wherein said cooling system is a passive cooling system.

7. The electrical device according to claim 1, wherein said at least one radiator of said cooling system is one of a plurality of radiators, but only one of said radiator has a heated heat exchange element.

* * * * *